United States Patent [19]

Masaki et al.

[11] 3,979,905

[45] Sept. 14, 1976

[54] THERMAL REACTOR

[75] Inventors: Kenji Masaki, Yokohama; Hatuo Nagaishi, Yokosuka; Yoshio Ookubo, Yokohama, all of Japan

[73] Assignee: Nissan Motor Co., Ltd., Yokohama, Japan

[22] Filed: Aug. 9, 1974

[21] Appl. No.: 496,185

[30] Foreign Application Priority Data

Aug. 17, 1973 Japan ..... 48-92286

[52] U.S. Cl. ..... 60/289; 23/277 C; 60/303; 60/306

[51] Int. Cl.[2] ..... F01N 3/14

[58] Field of Search..... 60/289, 303, 306, 39.72 R, 60/286; 23/277 C

[56] References Cited

UNITED STATES PATENTS

| | | | |
|---|---|---|---|
| 1,839,880 | 1/1932 | Hyatt | 60/303 |
| 2,065,681 | 12/1936 | Fogas | 60/303 |
| 2,944,399 | 7/1960 | McCardle | 60/39.72 R |
| 2,985,255 | 5/1961 | Clark | 60/303 |
| 3,059,420 | 10/1962 | Schnabel | 60/290 |
| 3,188,798 | 6/1965 | Jackson | 60/303 |
| 3,203,168 | 8/1965 | Thomas | 60/286 |
| 3,218,134 | 11/1965 | Walsh | 60/303 |
| 3,254,963 | 6/1966 | Leistritz | 60/303 |
| 3,481,144 | 12/1969 | Morrell | 60/286 |
| 3,826,089 | 7/1974 | Nakajima | 60/289 |
| 3,927,525 | 12/1975 | Jacobs | 60/301 |

*Primary Examiner*—Douglas Hart

[57] ABSTRACT

An elongate outer hollow member encloses an elongate inner hollow member to form an annular passage therebetween which communicates with an exhaust gas inlet of the outer hollow member. The inner hollow member has a combustion chamber defined therein, a plurality of ports formed through a closed upstream end portion and opening from the exhaust gas inlet into the combustion chamber for injection of a portion of exhaust gas thereinto and a plurality of ports formed through a side portion and opening from the annular passage into the combustion chamber for injection of the remaining portion of exhaust gas thereinto. An secondary air injection means is disposed in the combustion chamber adjacent to the closed end portion and upstream of the ports in the side portion for injection of secondary air into the combustion chamber.

6 Claims, 2 Drawing Figures

THERMAL REACTOR

Figures 1, 2:
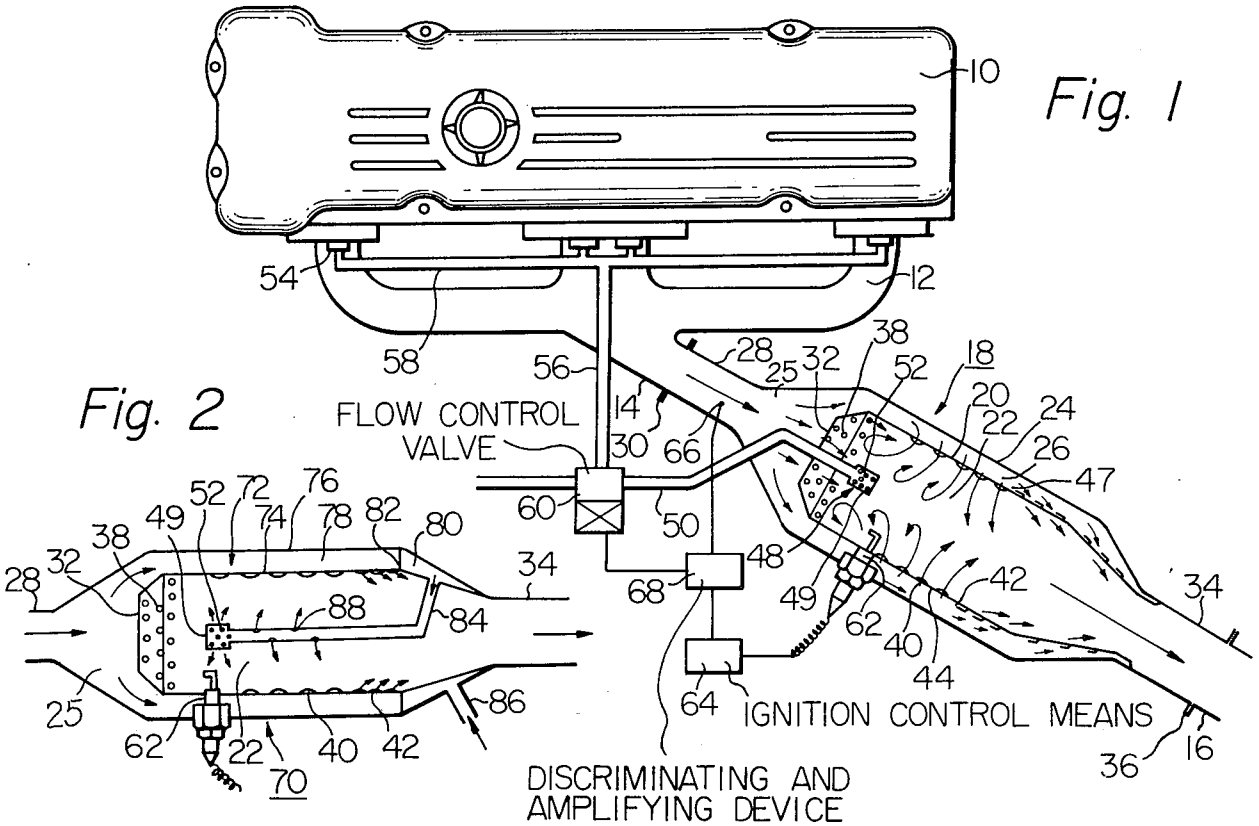

The present invention relates generally to an atmospheric pollution reducing system for an internal combustion engine and particularly to an improvement in a device for afterburing the exhaust gases from an internal combustion engine to render them harmless.

As an existing exhaust gas afterburning device of this kind, a thermal reactor is well known in the art, which heats a mixture of exhaust gases and fresh air and causes the oxidation reaction of the mixture to reduce the concentrations of harmful components such as hydrocarbons(HC's) and carbon monoxide(CO) in the exhaust gases. Such a thermal reactor includes an inner cylinder defining a combustion chamber therein and an outer cylinder enclosing the inner cylinder to form an annular passage therebetween. A conventional thermal reactor of this type has been constructed to introduce a mixture of exhaust gases and secondary air into an inner cylinder for combustion of the mixture in a combustion chamber and then introduce burned gases resulting from combustion of the mixture into an annular passage for heating of the inner cylinder. The purpose of this is to maintain the combustion chamber at a temperature high enough to support combustion of combustible content in exhaust gases, for example, at a temperature of from 950°C to 1,100°C. As a result, the life of the inner cylinder has been shortened even if the inner cylinder is made of a high grade heat-resistant material, since the internal and external surfaces of the inner cylinder are exposed to a high temperature. The outer cylinder must have been strongly and heavily made of a material such as a heat-resistant cast iron in order to prevent the outer cylinder from being damaged by heat. This causes increase in a vibration-resistant strength of an engine equipped with the thermal reactor. Moreover, the engine must have been supplied with an excessively rich air-fuel mixture in order to compensate for a low efficiency of combustion of the thermal reactor which results from high heat capacity thereof because of high mass. This causes increase in fuel consumption.

It is, therefore, an object of the invention to eliminate the above-mentioned shortcomings encountered in a conventional thermal reactor by providing an improved thermal reactor for an internal combustion engine.

This and other objects and advantages of the invention will become more apparent from the following detailed description taken in conjunction with the accompanying drawings in which:

FIG. 1 is a schematic view showing in cross section a preferred embodiment of a thermal reactor according to the invention; and FIG. 2 is a schematic cross sectional view showing a modification of the thermal reactor of FIG. 1.

Referring now to FIG. 1, there is shown an internal combustion engine 10 which is provided with a usual exhaust manifold 12 having an exhaust outlet 14. The exhaust manifold 12 forms a part of an exhaust gas passageway or conduit 16 which leads from a combustion chamber (not shown) of the engine 10 and is vented to the outside atmosphere by way of a muffler (not shown). A thermal reactor according to the invention generally designated by the numeral reference 18 is incorporated into the engine 10 to form a part of the exhaust gas conduit 16. The engine 10 serves as an exhaust gas source for the thermal reactor 18. THe thermal reactor 18 comprises an elongate inner hollow member 20 defining therein a combustion or reaction chamber 22 for combustion of exhaust gas therein and an elongate outer hollow member 24 defining therein a cavity 25 in which the inner hollow member 20 is located. Each of the inner and outer hollow members 20 and 24 may be a cylinder or a polygonal hollow post. The internal surface of the outer hollow member 24 is spaced apart from the external surface of the inner hollow member 20 by a suitable distance to form an exhaust gas jacket or annular clearance or passage 26 therebetween which surrounds the inner hollow member 20 and extends substantially the length of the inner hollow member 20. The outer hollow member 24 has an inlet or open end 28 which is fixedly secured to the exhaust outlet 14 of the exhaust manifold 12 as shown by a suitable fastening means such as a flange and a bolt as at 30 and constitutes an inlet for exhaust gases from the exhaust manifold 12 into the thermal reactor 18. The open end 28 communicates with the annular passage 26. The outer hollow member 24 is connected at the other end to the inner hollow member 20 to form a closed end of the annular passage 26. The inner hollow member 20 has a closed end or forward end or side wall 32 which faces the open end 28 of the outer hollow member 24 and closes one end of the combustion chamber 22. The combustion chamber 22 is open at the other end to communicate with an outlet or open end 34 of the thermal reactor 18 which is fixedly secured to the exhaust gas conduit 16 as shown by a suitable fastening means such as a flange and a bolt as at 36 and constitutes an outlet for treated gases to the exhaust gas conduit 16. The inner hollow member 20 has a first group of spaced ports or apertures 38 formed through the closed end 32 and opening from the cavity 25 into the combustion chamber 22 for discharge or injection of exhaust gases from the open end 28 thereinto and a second group of spaced ports or apertures 40 and a third group of spaced ports or apertures 42 formed through a side portion or main wall 44 of the inner hollow member 20, which wall defines the combustion chamber 22 together with the forward end wall 32 to completely surround the combustion chamber 22, and opening from the annular passage 26 into the combustion chamber 22 for discharge or injection of exhaust gases from the annular passage 26 thereinto. The third group of apertures 42 are located in the side portion 44 at a position downstream of the second group of apertures 40. Exhaust gases injected from the apertures 40 and 42 form a turbulent flow to provide a sufficiently long residence time for complete reaction of the exhaust gases in the combustion chamber 22. The intensity of turbulent flows formed in the combustion chamber 22 is determined by the locations, number, sizes, etc., of the apertures 40 and 42. The third group of apertures 42 may be formed to have louvers 47, respectively, opening above the external surface of the inner hollow member 20 and directed in the upstream direction of the annular passage. The louvers 47 serve to guide into the combustion chamber 22 exhaust gases flowing in the annular passage 26 to increase the amount of exhuast gases injected into the combustion chamber 22 from the apertures 42. The thermal reactor 18 and/or the exhaust manifold 12 may be covered by a layer of thermal insulation to enhance the efficiency of combustion or reaction of exhaust gases in the combustion chamber 22.

Air supply means 48 is provided to supply a predetermined amount of fresh secondary air to the combustion chamber 22. The air supply means 48 has an injection head 49 centrally located in the combustion chamber 22 adjacent to the closed end 32 and upstream of the second group of apertures 40 and communicating with a pressurized air source (not shown) such as an air pump or a blower fan by way of a conduit 50. The injection head 49 is formed with a plurality of ports or apertures 52 opening into the combustion chamber 22 for injection of secondary air thereinto. An injection nozzle 54 opens into the exhaust gas passageway 16 at a position adjacent to an exhaust port (not shown) of the combustion chamber of the engine 10 and communicates with the conduit 50 by way of conduits 56 and 58 combined to each other. A flow control valve 60 which may be of a solenoid type is disposed in the conduits 50 and 56 to control communication between the pressurized air source and the injection head 49 and between the pressurized air source and the injection nozzle 54. The flow control valve 60 normally provides communication between the pressurized air source and the injection head 49 and stops communication between the pressurized air source and the injection nozzle 54. The flow control valve 60 is actuated when the temperature of exhaust gases is lower than a predetermined value to reduce the flow or amount of secondary air fed from the pressurized air source into the injection head 49 to provide communication between the pressurized air source and the injection nozzle 54. Ignition means 62 which may be in the form of a spark plug passes through the inner hollow member 20 and is secured in the combustion chamber 22 subsequent to the injection head 49 to supply a spark to the combustion chamber 22 for ignition of a mixture of secondary air and exhaust gases therein. The ignition means 62 is connected to ignition control means 64 for energization thereby. The ignition control means 64 has a source of electric power (not shown). The ignition means 62 is energized by the ignition control means 64 to form an initial flame in the combustion chamber 22 when the engine 10 commences to run. The ignition means 62 may be energized to continuously ignite a mixture of exhaust gases and air to promote combustion in the combustion chamber 22 when the temperature of exhaust gases is lower than a predetermined value. Sensing means 66 is provided which detects the temperature of exhaust gases or a variable such as the concentration of oxygen in exhaust gases or intake manifold vacuum and engine speed which variable is representative of the temperature of exhaust gases. The sensing means 66 produces an electric output signal which is proportional to the exhaust gas temperature detected or the variable detected which corresponds thereto. The signal is transmitted from the sensing means 66 to a discriminating and amplifying device 68 which is electrically connected thereto. The device 68 compares the signal with a set point signal which is representative of a predetermined exhaust gas temperature or a variable corresponding thereto and produces an electric output signal when the value of the signal representing the detected exhaust gas temperature or variable is smaller than that of the set point signal. The device 68 is electrically connected to the flow control valve 60 to actuate the same with the output signal when the temperature of exhaust gas is lower than a predetermined value. The device 68 may be electrically connected to the ignition control means 64 to transmit the output signal thereto so that the ignition means 62 is continuously energized by the ignition control means 64 received the signal from the device 68 when the temperature of exhaust gases is lower than a predetermined value.

The operation of the thermal reactor 18 of FIG. 1 is as follows.

When the engine 10 begins to run, a portion of exhaust gases forced from the engine 10 to the thermal reactor 18 is injected into the combustion chamber 22 through the apertures 38 in the end portion 32 and the remaining portion of the exhaust gases is introduced into the annular passage 26. Secondary air is injected from the injection head 49 into the combustion chamber 22 and is mixed with the exhaust gases from the end portion 32. The mixture of the exhaust gases and secondary air is ignited by energization of the spark plug 62 so that combustible substances in the exhaust gases are reacted with secondary air to form an initial flame in the proximity of the ignition head 49. A mixture of exhaust gases from the end portion 32 and secondary air from the injection head 49 is ignited without energization of the spark plug 62 after formation of the initial flame. The burned gases are directed in the downstream direction together with secondary air injected from the injection head 49. The exhaust gases forced into the annular passage 26 are injected into the combustion chamber 22 through the apertures 40 and 42 in the side portion 44 and are discharged into the flow of the burned gases and secondary air. Combustible substances in the exhaust gases from the side portion 44 are reacted with secondary air by heat of the burned gases. The resultant burned gases are directed to the outlet 34. The flow of the exhaust gases injected from the side portion 44 is converted to a turbulent flow by the flow of the burned gases to produce a dynamic reaction atmosphere in the combustion chamber 22 and at the same time to increase a residence time of the exhaust gases in the combustion chamber 22, so that combustion of combustible substances in the exhaust gases is promoted. The louvers 47 of the third group of apertures 42 cause increase in the flow of exhaust gases injected therethrough to increase the amount of combustible constituents oxidized in the combustion chamber 22 and at the same time to effect cooling of the inner hollow member 20 at a downstream portion in which the burned gases are increased to a higher temperature.

When the temperature of exhaust gases is lower than a predetermined value, the flow control valve 60 is actuated by the signal from the discriminating and amplifying device 68 to provide communication between the pressurized air source and the injection nozzle 54 and to limit communication between the pressurized air source and the injection head 49. As a result, secondary air is injected into the exhaust port of the engine 10 through the injection nozzle 54 to oxidize at least a portion of combustible constituents in exhaust gases to cause increase in the temperature thereof. The exhaust gases having an increased temperature are injected into the combustion chamber 22 and cause increase in the reaction temperature in the combustion chamber 22. The exhaust gases injected also form an intensified turbulent flow in the combustion chamber 22 since the amount of the exhaust gases is increased by addition of secondary air. A reduced amount of secondary air is injected into the combustion chamber 22 through the injection head 49 to maintain the reaction temperature in the combustion chamber 22.

FIG. 2 illustrates a modification of the thermal reactor 18 of FIG. 1. A thermal reactor 70 of FIG. 2 is different from the thermal reactor 18 in that a jacket 72 formed between the external surface of an inner hollow member 74 and the internal surface of an outer hollow member 76 is separated into an exhaust gas annular passage 78 and a cooling air chamber or jacket 80 by a partition member 82, and in that a conduit 84 conducting secondary air to be injected into a combustion chamber 22 extends from the cooling air jacket 80 to an injection head 49 in the combustion chamber 22. The cooling air jacket 80 communicates with a pressurized air source (not shown) such as an air pump or a blower fan by way of a conduit 86 and serves as a heat exchanger in which air is heated by and cools the inner hollow member 74 at a downstream portion defining the jacket 80 and heated to a high temperature. The conduit 84 is heated by burned gases in the combustion chamber 22 to preheat secondary air passing to the injection head 49 through the conduit 84. Preheated secondary air, when injected in the combustion chamber 22, causes increase in reaction temperature therein to promote combustion of combustible substances in exhaust gases. The conduit 84 may have formed therethrough a plurality of spaced apertures 88 which inject preheated secondary air into the combustion chamber 22 prior to the injection head 49. Like component elements are designated by the same reference numerals as those used in FIG. 1.

It will be appreciated that both inner and outer hollow members of a thermal reactor according to the invention can be lightly made of a usual thin heat-resistant steel plate, since oxidation of exhaust gas is effected near a central portion of a combustion chamber and the internal surface of the inner hollow member is rarely touched directly by burned gas resulting from combustion of exhaust gas which is at a temperatue higher than that of exhaust gas, and since the burned gas are not introduced into a jacket between the external and internal surfaces of the inner and outer hollow members, respectively.

It will be further appreciated that the thermal reactor according to the invention can treat even exhaust gas containing a small amount of combustible substances and an engine equipped with the thermal reactor can be supplied with a lean air-fuel mixture to result in reduction in fuel consumption, since a large amount of secondary air is supplied from an injection head to a small amount of exhaust gas introduced from an end portion of the inner hollow member into the combustion chamber to enhance combustion of combustible constituents in the exhaust gas to increase the temperature of the resultant burned gas, and since the temperature of the burned gas is gradually increased as the burned gas flows in the downstream direction in the combustion chamber because of the burned gas flowing burning exhaust gas injected from a side portion of the inner hollow member into combustion chamber.

Although a thermal reactor according to the invention has been described as being incorporated into an internal combustion engine, the thermal reactor can employed for treating or cleaning exhaust gases emitted from an exhaust gas source such as a boiler firing equipment other than an internal combustion engine.

What is claimed is:

1. A thermal reactor for after-burning burnable components contained in exhaust gases, comprising an outer hollow member defining a cavity therein and having an inlet end through which exhaust gases are admitted into said cavity, an inner hollow member located in said cavity and formed therein with a combustion chamber and fixedly connected at a rearward end to said outer hollow member, said cavity providing a clearance between said outer and inner hollow members which clearance surrounds said inner hollow member and communicates at a forward end with said inlet end and is closed at a rearward end by said outer and inner hollow members at a position connected to each other, said inner hollow member having a forward end wall closing a forward end of said combustion chamber and formed therethrough with a plurality of ports opening from said cavity into said combustion chamber to admit said exhaust gases in said cavity thereinto, and a main wall defining said combustion chamber together with said forward end wall to completely surround said combustion chamber and formed therethrough with a plurality of ports opening from said clearance into said combustion chamber to admit said exhaust gases in said clearance thereinto, secondary air supply means having an outlet port opening into said combustion chamber for supply of secondary air thereinto and combustion of burnable components in said exhaust gases therein, said inner hollow member being unobstructed at said rearward end to allow said exhaust gases in said combustion chamber to the outside thereof, and an outlet end which is connected to said outer and inner hollow members at said position connected to each other and communicates with said combustion chamber to allow said exhaust gases therefrom to the outside of said thermal reactor.

2. A thermal reactor as claimed in claim 1, in which said secondary air supply means comprises an injection head centrally located in said combustion chamber at a position adjacent to said forward end wall and communicating with a source of secondary air under pressure, said injection head having a plurality of ports which open into said combustion chamber and radially inject secondary air toward said main wall.

3. A thermal reactor as claimed in claim 2 in combination with an internal combustion engine, in which said engine includes an exhaust gas passageway leading from a combustion chamber thereof and connected to said inlet end of said thermal reactor, and said secondary air supply means further comprises an injection nozzle communicating with said source of secondary air under pressure and opening into said exhaust gas passageway at a position adjacent to an exhaust port of said combustion chamber of said engine for injection of secondary air into said exhaust gas passageway, a flow control valve operable between a first position to obstruct fluid communication between said source and said injection nozzle and to provide fluid communication between said source and said injection head and a second position to provide fluid communication between said source and said injection nozzle and to reduce the flow of secondary air fed from said source into said injection head, and control means responsive to the temperature of said exhaust gases above a predetermined value to cause said control valve to assume said first position and responsive to the temperature of said exhaust gases below said predetermined value to cause said control valve to assume said second position.

4. A thermal reactor as claimed in claim 1, in which said plurality of ports formed through said main wall of said inner hollow member are arranged in forward and rearward groups, each of said ports of said rearward group having a louver opening above the external surface of said main wall and in the forward direction of said clearance.

5. A thermal reactor as claimed in claim 2, further comprising a partition member located in said clearance to define a cooling air chamber together with said outer and inner hollow members adjacent to said position connected to each other, said cooling air chamber communicating with said source and with said injection head, and a conduit extending in said combustion chamber from said cooling air chamber to said injection head.

6. A thermal reactor as claimed in claim 5, in which said conduit is formed with a plurality of outlet ports opening into said combustion chamber to inject secondary air thereinto.

* * * * *